US009687130B2

(12) United States Patent
Teng et al.

(10) Patent No.: US 9,687,130 B2
(45) Date of Patent: Jun. 27, 2017

(54) CONTROL METHOD FOR CLEANING ROBOTS

(71) Applicant: Micro-Star International Company Limited, New Taipei (TW)

(72) Inventors: You-Wei Teng, New Taipei (TW); Shih-Che Hung, Hsinchu (TW); Yao-Shih Leng, Taipei (TW)

(73) Assignee: MSI COMPUTER (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 13/768,626

(22) Filed: Feb. 15, 2013

(65) Prior Publication Data

US 2013/0218344 A1 Aug. 22, 2013

Related U.S. Application Data

(60) Provisional application No. 61/599,690, filed on Feb. 16, 2012.

(30) Foreign Application Priority Data

Oct. 25, 2012 (TW) ..... 101139410 A

(51) Int. Cl.

| | |
|---|---|
| ***G06F 17/00*** | (2006.01) |
| ***G06F 19/00*** | (2011.01) |
| ***G05B 15/00*** | (2006.01) |
| ***G05B 19/00*** | (2006.01) |
| ***A47L 11/40*** | (2006.01) |

(52) U.S. Cl.

CPC ..... *A47L 11/4061* (2013.01); *A47L 11/4011* (2013.01); *A47L 2201/00* (2013.01); *A47L 2201/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 2008/0051953 | A1* | 2/2008 | Jones | A47L 9/009 701/28 |
| 2009/0319083 | A1* | 12/2009 | Jones et al. | 700/259 |
| 2013/0214726 | A1* | 8/2013 | Teng et al. | 320/107 |
| 2013/0218342 | A1* | 8/2013 | Teng et al. | 700/259 |
| 2013/0218344 | A1* | 8/2013 | Teng et al. | 700/259 |

FOREIGN PATENT DOCUMENTS

| | | | |
|---|---|---|---|
| CN | 1923469 | A | 3/2007 |
| JP | 2002-73170 | A | 3/2002 |
| JP | 54-53483 | A | 8/2003 |
| JP | 2003-228421 | A | 8/2003 |
| JP | 2009-301247 | A | 12/2009 |
| TW | 201118522 | A1 | 6/2011 |

* cited by examiner

*Primary Examiner* — Bhavesh V Amin
(74) *Attorney, Agent, or Firm* — Birch, Stewart, Kolasch & Birch, LLP

(57) ABSTRACT

An embodiment of the invention provides a control method of a cleaning robot. The method includes steps of moving the cleaning robot according to a first direction; keeping moving the cleaning robot according to the first direction when a light detector of the cleaning robot detects a light beam; moving the cleaning robot for a predetermined distance and then stopping the cleaning robot when the light detector does not detect the light beam; and moving the cleaning robot in a second direction.

10 Claims, 8 Drawing Sheets

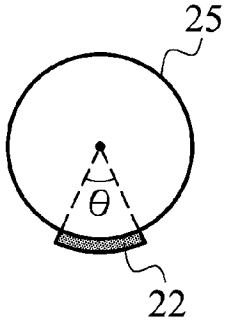
FIG. 2a
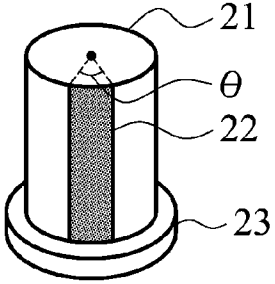
FIG. 2b
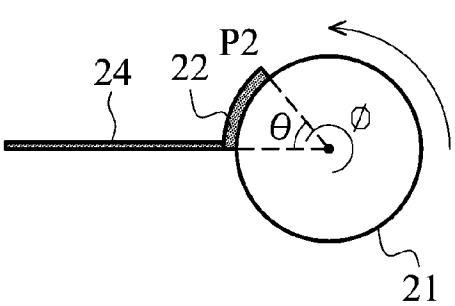
FIG. 2c
FIG. 2d
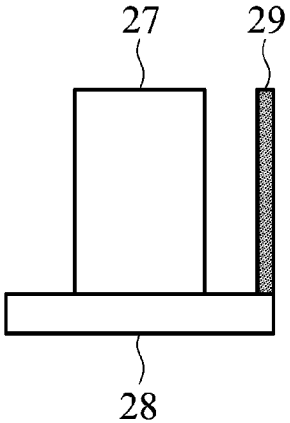
FIG. 2e

CONTROL METHOD FOR CLEANING ROBOTS

CROSS REFERENCE TO RELATED APPLICATIONS

This application claims the benefit of U.S. Provisional Application No. 61/599,690 filed Feb. 16, 2012, the entirety of which is incorporated by reference light generating devices Application claims priority of Taiwan Patent Application No. 101139410, filed on Oct. 25, 2012, the entirety of which is incorporated by reference herein.

BACKGROUND OF THE INVENTION

Field of the Invention

The invention relates to a cleaning robot, and more particularly, to a cleaning robot with a non-omnidirectional light detector.

Description of the Related Art

A variety of movable robots, which generally include a driving means, a sensor and a travel controller, and perform many useful functions while autonomously operating, have been developed. For example, a cleaning robot for the home, is a cleaning device that sucks dust and dirt from the floor of a room while autonomously moving around the room without user manipulation.

BRIEF SUMMARY OF THE INVENTION

An embodiment of the invention provides a control method of a cleaning robot. The method comprises steps of moving the cleaning robot according to a first direction; keeping moving the cleaning robot according to the first direction when a light detector of the cleaning robot detects a light beam; moving the cleaning robot for a predetermined distance and then stopping the cleaning robot when the light detector does not detect the light beam; and moving the cleaning robot in a second direction.

Another embodiment of the invention provides a cleaning robot comprising a controller and a light detector. The controller controls the cleaning robot to move in a first direction. The light detector is coupled to the controller and detects a light beam. When detecting the light beam output by a light generating device, the light detector transmits a first trigger signal to the controller. When the light detector does not detect the light beam, the light detector transmits a second trigger signal to the controller. The controller controls the cleaning robot to stop after moving a distance and leaves a restricted area labeled by the light beam in a second direction.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein:

FIG. 2*a* is a top view of an embodiment of a non-omnidirectional light detector according to the invention.

FIG. 2*b* is a flat view of the non-omnidirectional light detector of FIG. 2*a*.

FIGS. 2*c* and 2*d* are schematic diagrams for estimating an incident angle of a light beam by using the proposed non-omnidirectional light detector according to the invention.

FIG. 2*e* is a schematic diagram of another embodiment of a non-omnidirectional light detector according to the invention.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
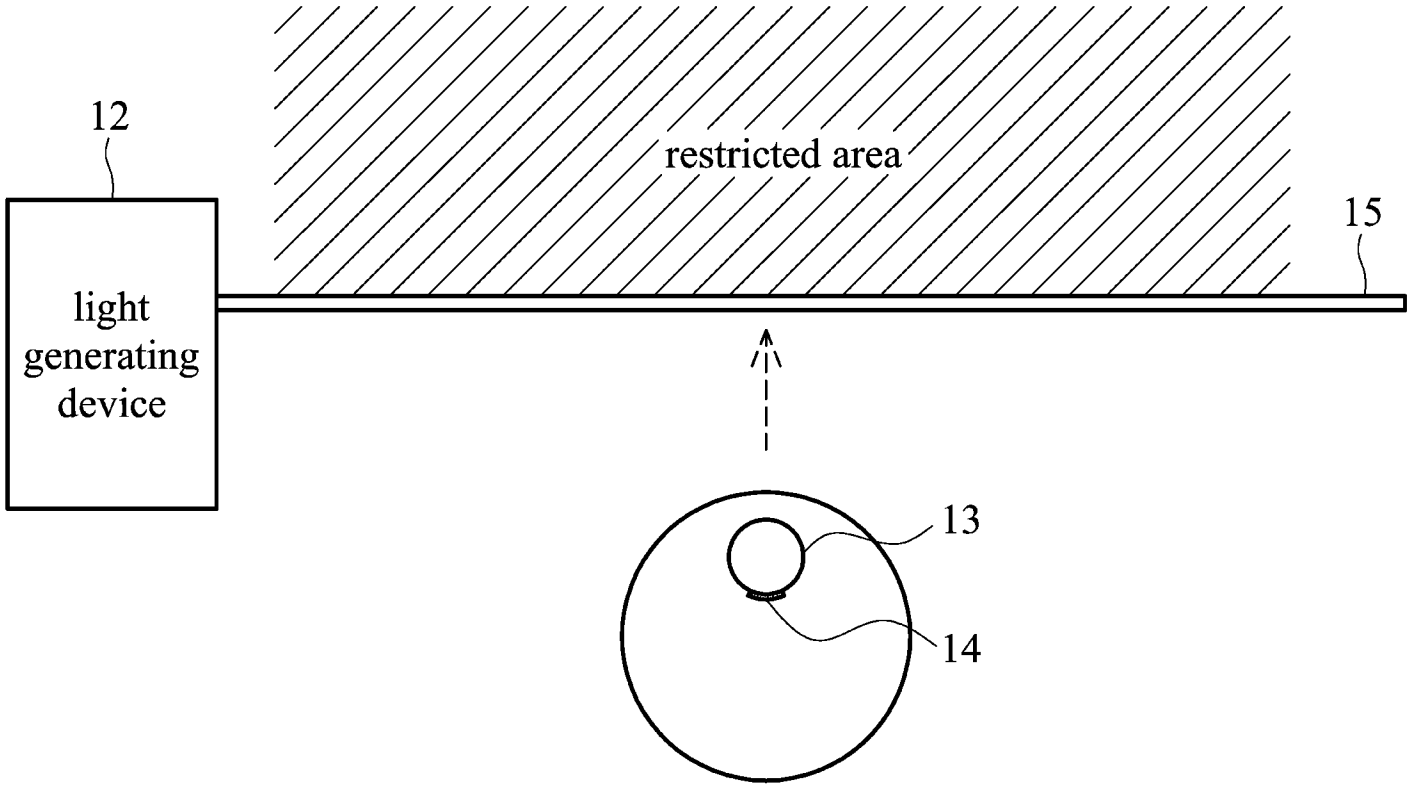
FIG. 1 is a schematic diagram of a light generating device and a cleaning robot according to an embodiment of the invention.

FIG. 1 is a schematic diagram of a light generating device and a cleaning robot according to an embodiment of the invention. The light generating device 12 outputs a light beam 15 to label a restricted area that the cleaning robot 11 cannot enter. The cleaning robot 11 comprises a non-omnidirectional light detector 13 having a rib (or called mask) 14, where the rib 14 produces a shadowed area on the non-omnidirectional light detector 13 by a predetermined angle and the range of the predetermined angle is from 30 degrees to 90 degrees.

The rib 14 may be fixed on the surface of the non-omnidirectional light detector 13 or movable along the non-omnidirectional light detector 13. The rib 14 can be spun in 360 degrees along the surface of the non-omnidirectional light detector 13. In this embodiment, the term, non-omni, is a functional description to describe that the rib 14 causes an area on the surface of the non-omnidirectional light detector 13 and the non-omnidirectional light detector 13 cannot not detect light therein or light to not directly reach that area.

Thus, the non-omnidirectional light detector 13 can be implemented in two ways. The first implementation is to combine an omni-light detector with a rib 14 and the rib 14 is fixed on a specific position of the surface of the omni-light detector. The non-omnidirectional light detector 13 is disposed on a plate that can be spun by a motor. Thus, the purpose of spinning of the non-omnidirectional light detector 13 can be achieved. When the non-omnidirectional light detector 13 detects the light beam, an incident angle of the light beam 15 can be determined by spinning the non-omnidirectional light detector 13.

Another implementation of the non-omnidirectional light detector 13 is implemented by telescoping a mask kit on an omni-light detector, wherein the omni light detector cannot be spun and the masking kit is movable along a predetermined track around the omni light detector. The mask kit is spun by a motor. When the non-omnidirectional light detector 13 detects the light beam 15, the mask kit is spun to determine the incident angle of the light beam 15.

Reference can be made to FIGS. 2*a* to 2*e* for the detailed description of the non-omnidirectional light detector 13.

FIG. 2*a* is a top view of an embodiment of a non-omnidirectional light detector according to the invention. The mask 22 is formed by an opaque material and is adhered to a part of sensing area of an omni light detector 21. The mask 22 forms a sensing dead zone with an angle θ on the omni light detector 21.

Please refer to FIG. 2*b*. FIG. 2*b* is a flat view of the non-omnidirectional light detector of FIG. 2*a*. In FIG. 2*b*, the omni light detector 21 is fixed on a base 23. The base 23 can be driven and spun by a motor or a step motor. A controller of the cleaning robot outputs a control signal to spin the base 23. Although the typical type of omni light detector 21 can receive light from any direction, the omni light detector 21 cannot determined the direction that the light comes from and the cleaning robot cannot know the position of a light generating device or charging station. With the help of the mask 22, the light direction can be determined.

When the omni light detector 21 detects a light beam, the base 23 is set to be spun for 360 degrees in a clockwise direction or a counter clockwise direction. When the omni light detector 21 cannot detect the light beam, a controller of the cleaning robot calculates a spin angle of the base 23, wherein the spin angle ranges from 0 degree to (360-θ) degrees. The controller then determines the direction of the light beam according to a spin direction of the base 23, the spin angle and the angle θ. Reference can be made to the descriptions related to FIG. 2*c* and FIG. 2*d* a more detailed description for estimating an incident angle of a light beam.

FIGS. 2*c* and 2*d* are schematic diagrams for estimating an incident angle of a light beam by using the proposed non-omnidirectional light detector according to the invention. In FIG. 2*c*, the initial position of the mask 22 is at P1. When the non-omnidirectional light detector 25 detects a light beam 24, the non-omnidirectional light detector 25 is spun in a predetermined direction. In this embodiment, the predetermined direction is a counter clockwise direction. In FIG. 2*d*, when the non-omnidirectional light detector 25 does not detect the light beam 24, the non-omnidirectional light detector 25 stops spinning. The controller of the cleaning robot determines a spin angle Φ of the non-omnidirectional light detector 25 and estimates the direction of the light beam 24 according to the spin angle Φ and the initial position P1.

In another embodiment, the non-omnidirectional light detector 25 is driven by a motor, and the motor transmits a spin signal to the controller for estimating the spin angle Φ. In another embodiment, the non-omnidirectional light detector 25 is driven by a step motor. The step motor is spun according to numbers of received impulse signals. The controller therefore estimates the spin angle Φ according to the number of impulse signals and a step angle of the step motor.

In another embodiment, the non-omnidirectional light detector 25 is fixed on a base device with a gear disposed under the base device, wherein meshes of the gear are driven by the motor. In another embodiment, the non-omnidirectional light detector 25 is driven by the motor via a timing belt.

FIG. 2*e* is a schematic diagram of another embodiment of a non-omnidirectional light detector according to the invention. The non-omnidirectional light detector 26 comprises an omni light detector 27, a base 28 and a vertical extension part 29 formed on the base 28. The vertical extension part 29 is formed by an opaque material and forms a dead zone area on the surface of the omni light detector 27. When the light beam is toward to the dead zone area, the omni light detector 27 cannot detect the light beam. The base 28 is spun by a motor to detect a light direction. The omni light detector 27 is not physically connected to the base 28 and the omni light detector 27 is not spun when the base is spun by the motor. Reference can be made to the descriptions related to FIGS. 2*c* and 2*d* for the light direction detection operation of the non-omnidirectional light detector 26.

Figure 3A:
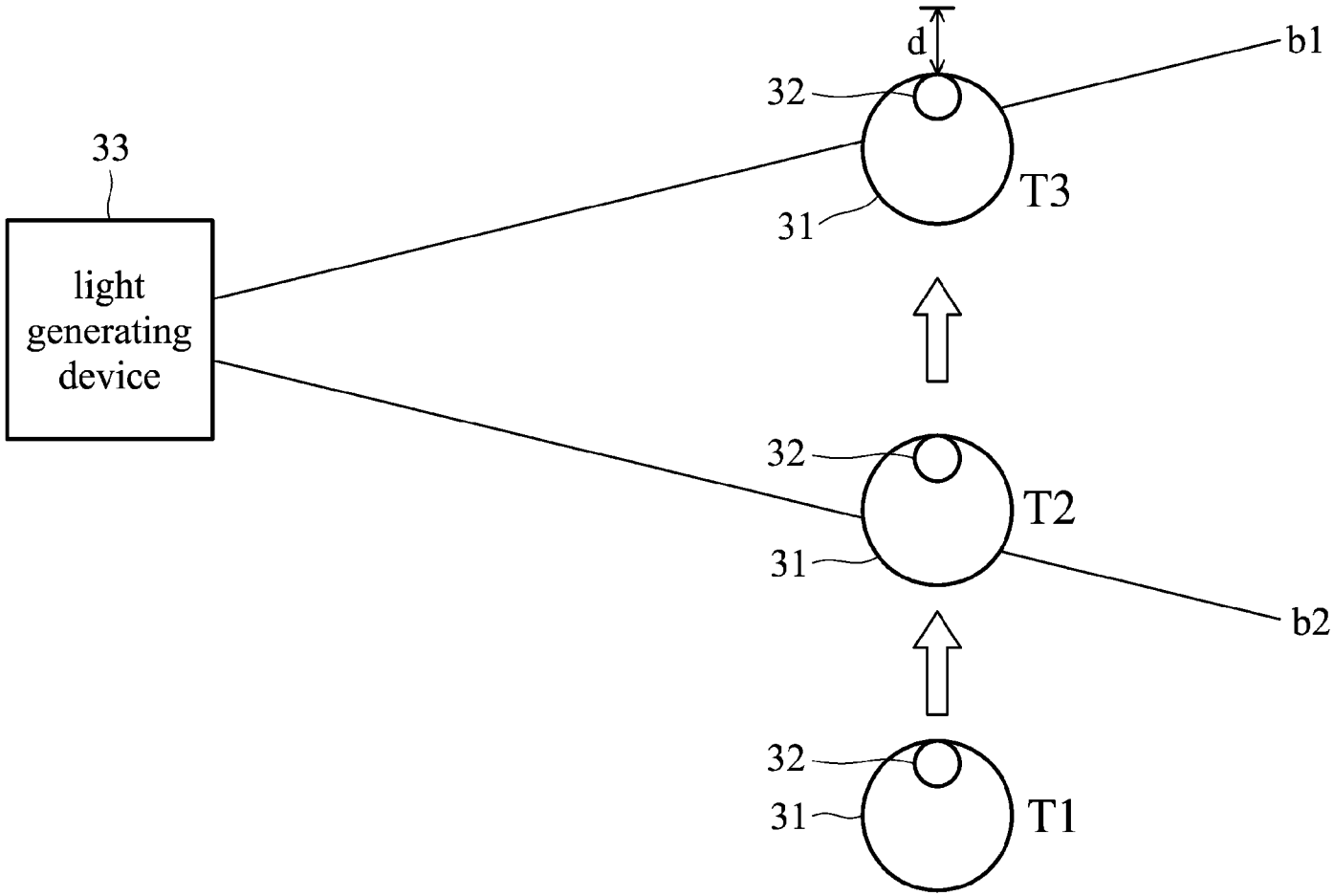
FIG. 3*a* and FIG. 3*b* show a schematic of a control method of a cleaning robot according to an embodiment of the invention.
Figure 3B:
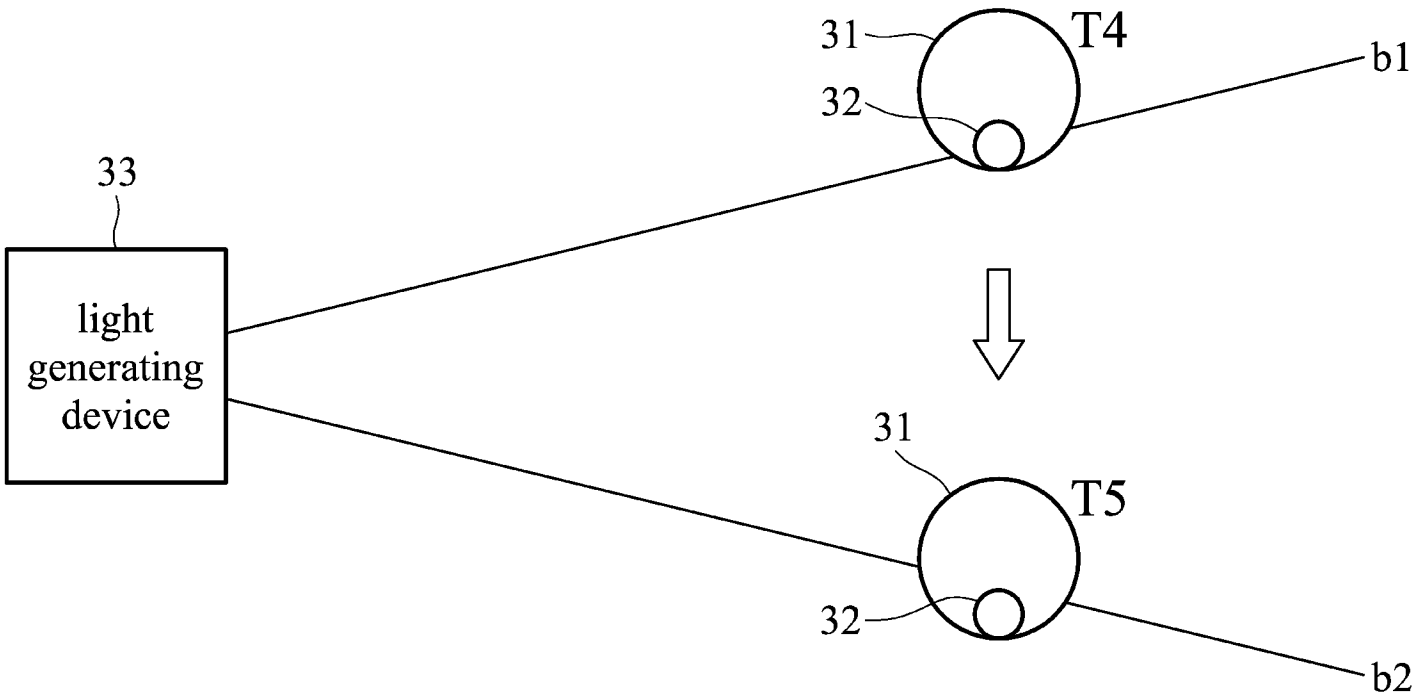

FIG. 3*a* and FIG. 3*b* show a schematic of a control method of a cleaning robot according to an embodiment of the invention. The light generating device 33 outputs a light beam to label a restricted area that the cleaning robot 31 cannot enter. The light beam comprises a first boundary b1 and a second boundary b2. At time T1, the cleaning robot 31 moves along a predetermined route. At time T2, the light detector 32 detects a first boundary b1 of the light beam output by the light generating device 33. The cleaning robot 31 keeps moving along the predetermined route. In this embodiment, the light detector is a non-omnidirectional light detector or an omnidirectional light detector.

At time T3, the light detector 32 does not detect the light beam output by the light generating device 33. The cleaning robot 31 keeps moving for a distance d and then is spun 180 degrees. At time T4 of FIG. 3*b*, the light detector 32 detects a first boundary b1 of the light beam output by the light generating device 33. At time T5, the light detector 32 does not detect the light beam output by the light generating device 33. A controller of the cleaning robot 31 determines whether the cleaning robot 31 has left the restricted area according to the detection results of the light detector 32 at time T4 and time T5.

Figure 4:
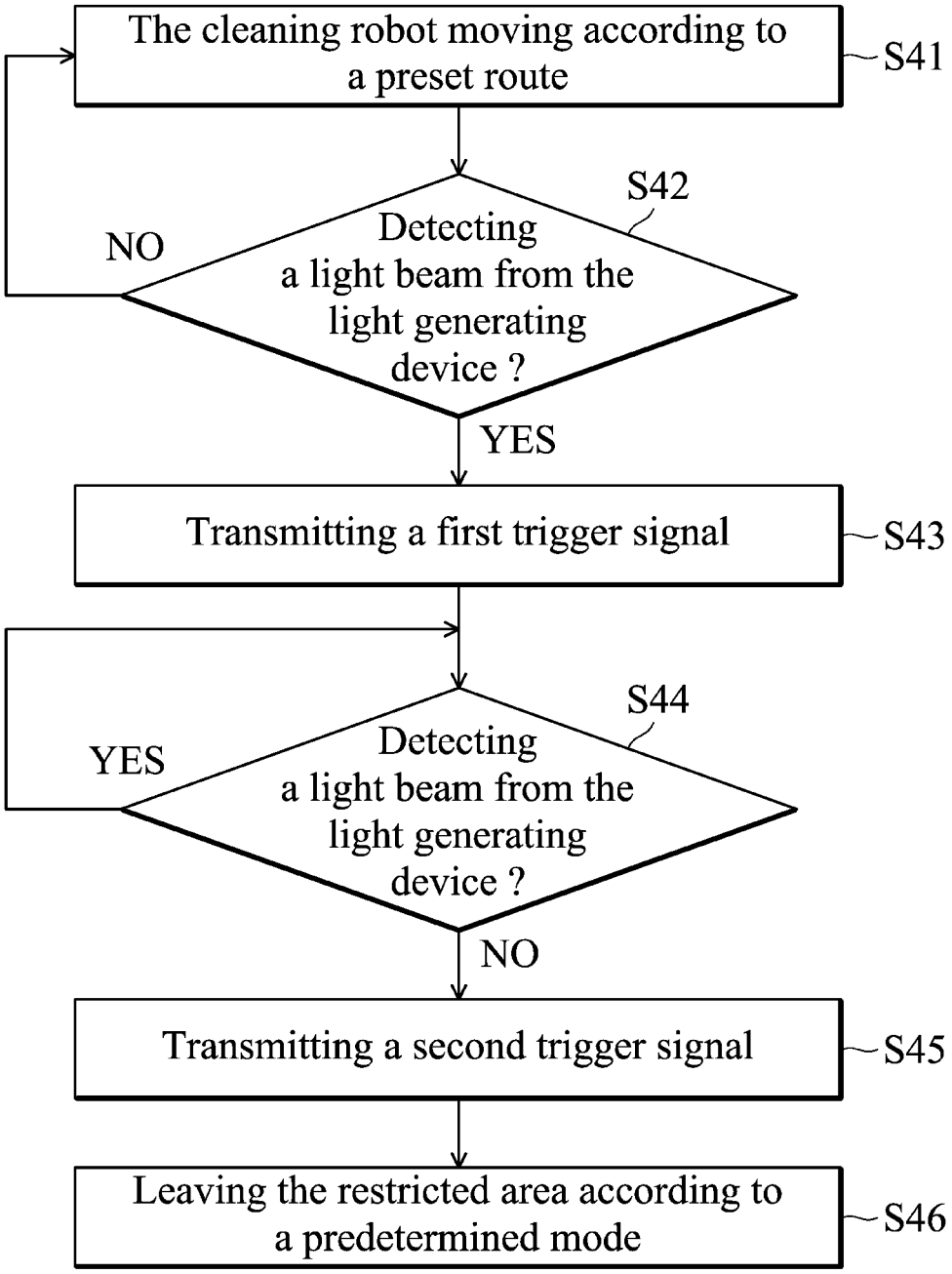
FIG. 4 is a flowchart of a control method for a cleaning robot according to an embodiment of the invention.

FIG. 4 is a flowchart of a control method for a cleaning robot according to an embodiment of the invention. In the step S41, the cleaning robot moves according to a preset route. In the step S42, a controller of a light detector determines whether a light beam from the light generating device is detected by the light detector of the cleaning robot. If the light detector detects the light beam from the light generating device, step S43 is executed. In this embodiment, the light detector is an omnidirectional light detector or a non-omnidirectional light detector, such as shown in FIG. 2*a*-FIG. 2*e*.

In the step S43, the controller of the light detector transmits a first trigger signal to a controller of the cleaning robot. In the step S44, the controller of the light detector determines whether the light detector detects the light beam from the light generating device. If yes, step S44 is still executed. If not, step S45 is executed. In the step S45, the controller of the light detector transmits a second trigger to the controller of the cleaning robot. In the step S46, the controller of the cleaning robot executes a corresponding procedure and the cleaning robot therefore move away from the restricted area labeled by the light beam output by the light generating device.

In this embodiment, the first trigger signal is a rising edge-triggered signal and the second trigger signal is a falling edge-triggered signal.

Figure 5:
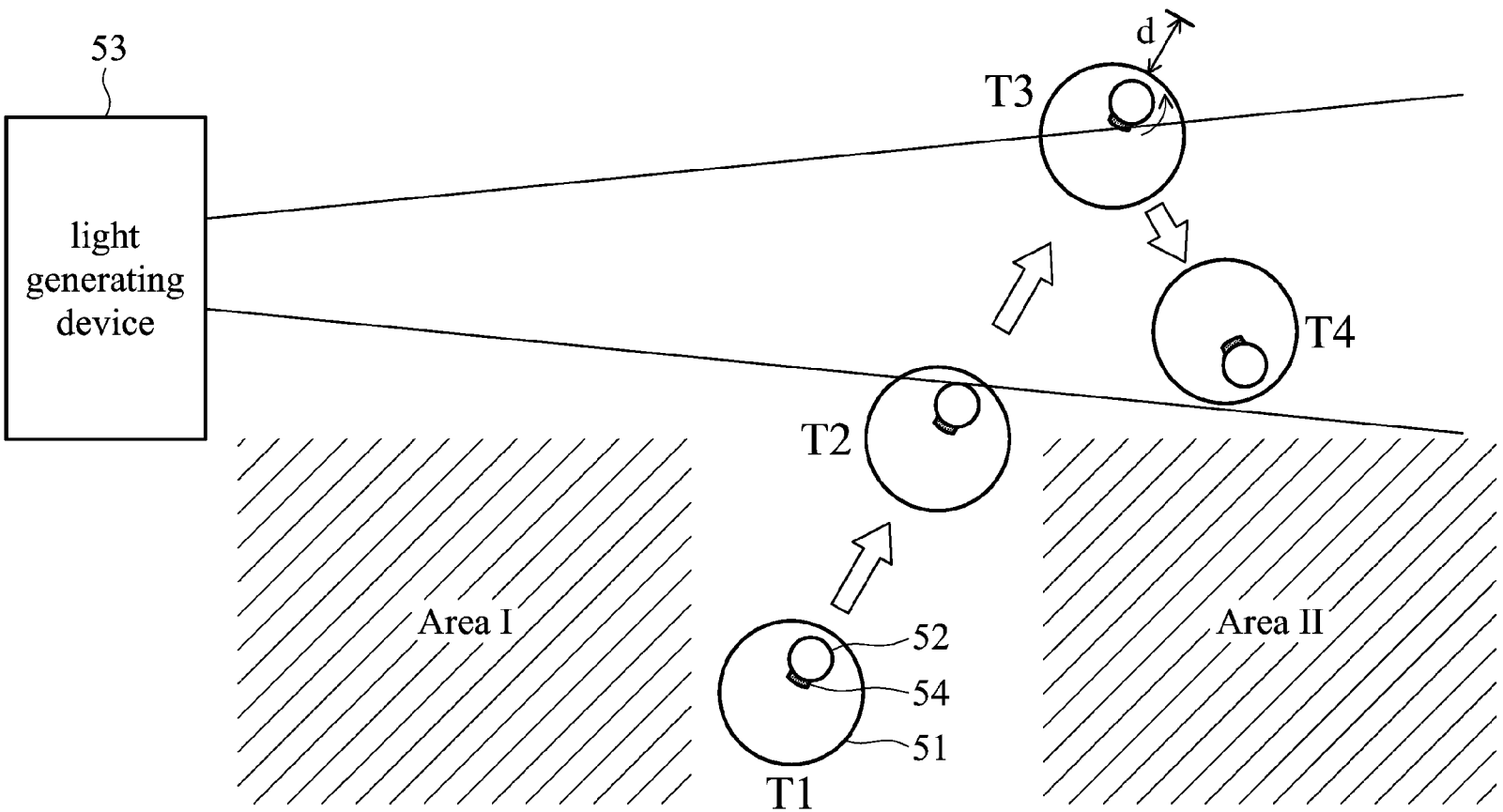
FIG. 5 shows a schematic of a control method of a cleaning robot according to another embodiment of the invention.

FIG. 5 shows a schematic of a control method of a cleaning robot according to another embodiment of the invention. The light generating device 53 outputs a light beam to label a restricted area that the cleaning robot 51 cannot enter. The light beam comprises a first boundary b1 and a second boundary b2. At time T1, the cleaning robot 51 moves along a predetermined route. At time T2, the non-omnidirectional light detector 52 detects a first boundary b1 of the light beam output by the light generating device 53. The cleaning robot 51 does not stop immediately but stops after the cleaning robot 51 keeps moving for a distance d.

At time T2, when the non-omnidirectional light detector 52 detects the light beam output by the light generating device 53, a controller of the cleaning robot 51 receives a first trigger signal. The controller of the cleaning robot 51 therefore knows that the cleaning robot 51 is near the restricted area and the controller can execute some operations, such as slowing down the moving speed of the cleaning robot 51, pre-activating a light detection At time T3, the non-omnidirectional light detector 52 does not detect the light beam output by the light generating device 53. It means that the cleaning robot 51 has entered the restricted area. The controller of the cleaning robot 51 receives a second trigger signal and the controller prepares to stop the cleaning robot 51 according to the second trigger signal. In this embodiment, when the controller receives the second trigger signal, the controller stops the cleaning robot 51 after a predetermined duration t. In another embodiment, when the controller receives the second trigger signal, the controller stops the cleaning robot 51 after N clock cycles or N sampling times.

The controller determines the distance d or the duration t according to a moving speed, a moving mode or a breaking time.

At time T3, the non-omnidirectional light detector 52 is spun to determine the position of the light generating device 53. Then, the controller of the cleaning robot 51 determines how the cleaning robot 51 leaves the light beam from the light generating device 53. The controller of the cleaning robot 51 controls the cleaning robot 51 to spin 180 degrees and leaves along the original route or in another direction.

Assuming the controller of the cleaning robot 51 determines that the area I is not cleaned yet, the cleaning robot 51 is spun 180 degrees and leaves along the original route. When the cleaning robot 51 leaves the second boundary b2 of the light beam from the light generating device 53, the cleaning robot 51 moves to the light generating device 53 along the second boundary b2 and cleans the area that the cleaning robot 51 had passed.

In another embodiment, if the controller of the cleaning robot 51 determines that the area I had been cleaned, and the area II is not cleaned yet, the controller of the cleaning robot 51 determines a shortest path to the area II and determines a first direction according to the shortest path. Then, the cleaning robot 51 moves in the first direction. In other words, the controller of the cleaning robot 51 controls the cleaning robot 51 to move to the un-cleaned area according to the cleaned area and the previous moving track.

Figure 6:
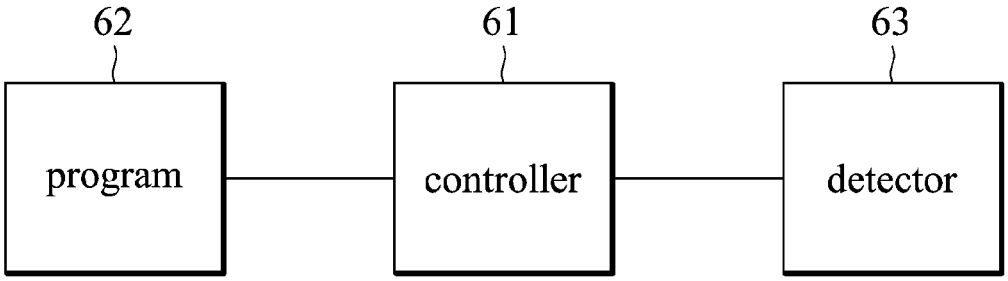
FIG. 6 is a functional block diagram of an embodiment of a cleaning robot according to the invention.

FIG. 6 is a functional block diagram of an embodiment of a cleaning robot according to the invention. The controller 61 executes the program 62 and controls a detector 63 coupled to a general purpose input/output (GPIO) pin GPIO_1 of the controller 61. The logic level of the pin GPIO_1 is preset at a first logic level. When the detector 63 detects the light beam output by a light generating device, the logic state of the pin GPIO_1 is changed from the first logic level to the second logic level. When the detector 63 does not detect the light beam output by a light generating device, the logic state of the pin GPIO_1 is changed from the second logic level to the first logic level. Thus, when the controller 61 receives a square wave signal via the pin GPIO_1, it means that the cleaning robot has entered the restricted area.

Figure 7:
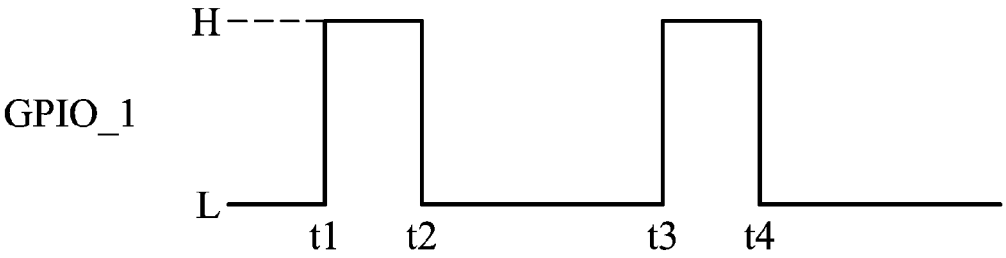
FIG. 7 is a schematic diagram of a logic level of the pin GPIO_1 of FIG. 6.

FIG. 7 is a schematic diagram of a logic level of the pin GPIO_1 of FIG. 6. Before time t1, the pin GPIO_1 maintains at the preset logic low level (L). At time t1, the light detector detects the light beam from the light generating device and the light detector pulls the logic level of the pin GPIO_1 to a logic high level (H). During the duration between time t1 and time t2, the logic level of the pin GPIO_1 maintains at the logic high level (H) because the cleaning robot is moving at the area covered by the light beam from the light generating device.

At time t2, the cleaning robot leaves the area covered by the light beam from the light generating device and the light detector does not detect the light beam from the light generating device. The light detector pulls the logic level of the pin GPIO_1 down to a logic low level (L). During the duration between time t2 and time t3, the cleaning robot moves a distance and leaves the restricted area in a first direction. The cleaning robot passes the area covered by the light beam from the light generating device again.

At time t3, the light detector detects the light beam from the light generating device again, and the light detector pulls the logic level of the pin GPIO_1 to a logic high level (H). During the duration between time t3 and time t4, the logic level of the pin GPIO_1 maintains at the logic high level (H) because the cleaning robot is moving at the area covered by the light beam from the light generating device.

According to the above paragraphs, when the controller 61 detects the first square wave signal, such as the square wave signal between time t1 and time t2, the cleaning robot has entered the restricted area. When the controller 61 detects the second square wave signal, such as the square wave signal between time t3 and time t4, the cleaning robot has left the restricted area. Thus, the controller 61 controls the cleaning robot to leave the restricted area according to the program 62 and determines whether the cleaning robot has left the restricted area according to the number of the detected square wave signals.

Figure 8:
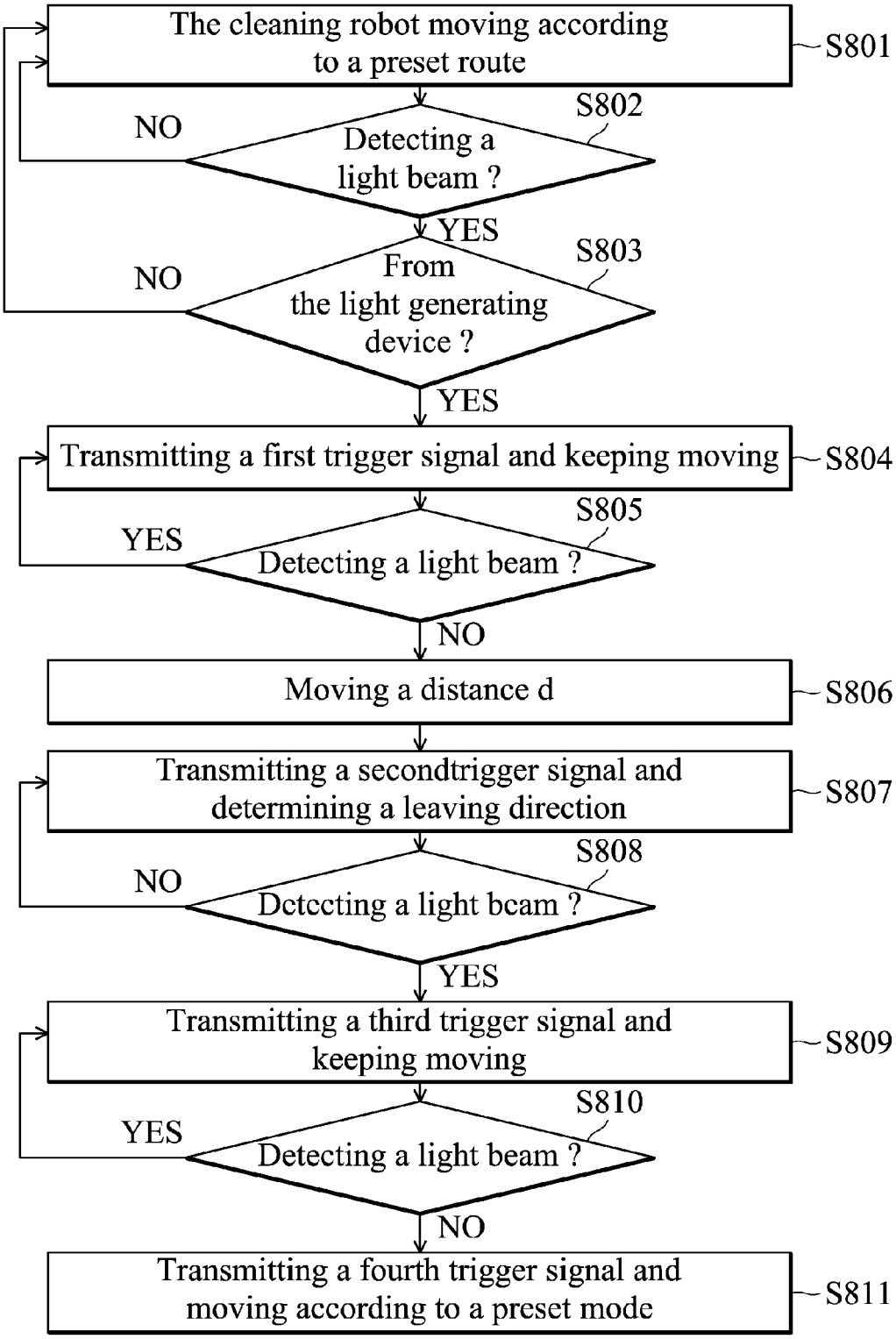
FIG. 8 is a flowchart of a control method for a cleaning robot according to another embodiment of the invention.

FIG. 8 is a flowchart of a control method for a cleaning robot according to another embodiment of the invention. In the step S801, the cleaning robot moves according to a preset route. In the step S802, a controller of a light detector determines whether a light beam is detected by the light detector of the cleaning robot. If not, step S801 is executed. If the light detector detects the light beam from the light generating device, step S803 is executed to confirm whether the light beam is output by the light generating device. If the light beam is not output by the light generating device, step S801 is executed. If the light beam is output by the light generating device, step S804 is then executed.

In the step S804, the controller of the light detector transmits a first trigger signal to a controller of the cleaning robot, and the cleaning robot still moves along the preset route. In the step S805, the controller of the light detector or the controller of the cleaning robot determines whether the light detector detects the light beam. If yes, step S804 is executed. If light detector does not detect the light beam, the step S806 is executed.

In the step S806, the controller of the light detector transmits a second trigger signal to the controller of the cleaning robot. Then, in the step S807, the controller of the cleaning robot determines a leaving direction and the cleaning robot left from the restricted area according to the leaving direction.

In the step S808, the controller of the light detector determines whether the light detector detects the light beam. If the light detector does not detect the light beam, the procedure returns to the step S807. If the light detector detects the light beam, step S809 is executed. In the step S809, the light detector transmits a third trigger signal to a controller of the cleaning robot, and the cleaning robot keeps moving.

In the step S810, the controller of the light detector or the controller of the cleaning robot determines whether the light detector detects the light beam. If yes, step S809 is executed and the cleaning robot keeps moving along the preset route. If light detector does not detect the light beam, the step S811 is executed.

In the step S811, the controller of the light detector transmits a fourth trigger signal to the controller of the cleaning robot. When the controller of the cleaning robot receives the third trigger signal and the fourth trigger signal, the controller of the cleaning robot confirms that the cleaning robot has left the restricted area. In other words, the third trigger signal and the fourth trigger signal can be referenced for determining whether the cleaning robot has left the restricted area.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A control method of a cleaning robot, executed by a controller embedded in the cleaning robot, comprising:

moving the cleaning robot according to a first direction before a light detector of the cleaning robot detects a light beam;

receiving a first trigger signal transmitted from the light detector and keeping moving the cleaning robot according to the first direction when the light detector of the cleaning robot detects the light beam;

receiving a second trigger signal transmitted from the light detector, moving the cleaning robot for a predetermined distance along the first direction to let the light detector of the cleaning robot pass through the light beam and then stopping the cleaning robot when the light detector does not detect the light beam; and moving the cleaning robot in a second direction to leave a restricted area labeled by the light beam, wherein when the cleaning robot moves in the second direction and the light detector detects the light beam, the light detector transmits a third trigger signal to the controller, and when the light detector does not detect the light beam, the light detector transmits a fourth trigger signal to the controller, and the controller determines whether the cleaning robot has left the restricted area according to the third trigger signal and the fourth trigger signal.

2. The control method as claimed in claim 1, further comprising: determining whether the light beam is output by a light generating device; and moving the cleaning robot in the first direction when the light beam is not output by the light generating device.

3. The control method as claimed in claim 1, wherein the second direction is an opposite direction of the first direction.

4. The control method as claimed in claim 1, wherein the predetermined distance is determined according to a moving speed and a breaking time of the cleaning robot.

5. A cleaning robot, comprising:

a controller to control the cleaning robot to move in a first direction; and a light detector coupled to the controller to detect a light beam, wherein when detecting the light beam output by a light generating device, the light detector transmits a first trigger signal to the controller, and the controller controls the cleaning robot to keep moving along the first direction until the light detector of the cleaning robot passes through the light beam, when the light detector does not detect the light beam, the light detector transmits a second trigger signal to the controller, and the controller controls the cleaning robot to stop after moving a distance and leaves a restricted area labeled by the light beam in a second direction, wherein before the light detector detects the light beam, the controller controls the cleaning robot to move in the first direction, and wherein when the cleaning robot moves in the second direction and the light detector detects the light beam, the light detector transmits a third trigger signal to the controller, and when the light detector does not detect the light beam, the light detector transmits a fourth trigger signal to the controller, and the controller determines whether the cleaning robot has left the restricted area according to the third trigger signal and the fourth trigger signal.

6. The cleaning robot as claimed in claim 5, wherein the second direction is an opposite direction of the first direction.

7. The cleaning robot as claimed in claim 5, wherein the distance is determined according to a moving speed and a breaking time of the cleaning robot.

8. The cleaning robot as claimed in claim 5, wherein the light detector is a non-omnidirectional light detector.

9. The cleaning robot as claimed in claim 5, wherein when the cleaning robot leaves the restricted area, the cleaning robot moves to the light generating device along the light beam.

10. A control method of a cleaning robot, which comprises a controller and a light detector, the method comprising:

moving the cleaning robot according to a first direction before the light detector of the cleaning robot detects a light beam;

providing a first trigger signal to the controller and keeping moving the cleaning robot according to the first direction when the light detector of the cleaning robot detects the light beam;

providing a second trigger signal to the controller, moving the cleaning robot for a predetermined distance to let the light detector of the cleaning robot passing through the light beam to leave a restricted area labeled by the light beam and then stopping the cleaning robot when the light detector does not detect the light beam, wherein a first square wave signal is generated when the cleaning robot is stopped;

moving the cleaning robot in a second direction to enter an un-cleaned area;

when the cleaning robot moves in the second direction and the light detector detects the light beam, the light detector transmits a third trigger signal to the controller and the controller controls the cleaning robot to keep moving along the second direction; and when the light detector fails to detect the light beam during a moving along the second direction, the light detector transmits a fourth trigger signal to the controller and a second square wave signal is generated to inform the controller that the cleaning robot has left the restricted area.

* * * * *